US005636499A

United States Patent [19]

Kramps et al.

[11] Patent Number: 5,636,499

[45] Date of Patent: Jun. 10, 1997

[54] METHOD AND APPARATUS FOR WRAPPING COVERING ELEMENTS AROUND PRINTED PRODUCTS

[75] Inventors: Jan W. Kramps, Huizen; Henk De Vlaam, Almere, both of Netherlands

[73] Assignee: B.V. Metaverpa, Soest, Netherlands

[21] Appl. No.: 388,829

[22] Filed: Feb. 15, 1995

[30] Foreign Application Priority Data

Mar. 8, 1994 [CH] Switzerland ..... 00680/94

[51] Int. Cl.[6] ..... B65B 11/18

[52] U.S. Cl. ..... 53/465; 53/116; 53/117; 53/120; 53/429; 53/209; 53/210; 53/228; 53/466

[58] Field of Search ..... 53/116, 117, 120, 53/209, 210, 211, 228, 232, 234, 378.3, 387.2, 399, 429, 465, 466, 586, 590

[56] References Cited

U.S. PATENT DOCUMENTS

| | | | |
|---|---|---|---|
| 517,440 | 4/1894 | Crowell | 53/232 X |
| 517,441 | 4/1894 | Crowell | 53/586 |
| 527,521 | 10/1894 | Crowell | 53/586 |
| 722,879 | 3/1903 | Owens | 53/117 X |
| 868,258 | 10/1907 | Farnham | 53/120 |
| 911,542 | 9/1909 | Owens | 53/117 |
| 1,071,853 | 9/1913 | Young | 53/120 |
| 1,152,794 | 9/1915 | Cox | 53/120 |
| 2,347,560 | 4/1944 | Hoppe | 53/210 |
| 2,382,420 | 8/1945 | Jensen | 53/210 |
| 3,145,516 | 8/1964 | Hannon et al. . | |
| 3,417,987 | 12/1968 | Hannon et al. . | |
| 5,095,682 | 3/1992 | Steidinger | 53/429 X |

FOREIGN PATENT DOCUMENTS

| | | | |
|---|---|---|---|
| 185811 | 7/1986 | European Pat. Off. | 53/429 |
| 0568844 | 11/1993 | European Pat. Off. . | |
| 0588758 | 3/1994 | European Pat. Off. . | |
| 0618138 | 10/1994 | European Pat. Off. . | |
| 327662 | 6/1903 | France . | |
| 153986 | 8/1902 | Germany . | |
| 161545 | 7/1904 | Germany . | |
| 237483 | 1/1909 | Germany . | |

*Primary Examiner*—Daniel Moon

*Attorney, Agent, or Firm*—Spencer & Frank

[57] ABSTRACT

A method and apparatus for wrapping covering elements around flat objects. The method and apparatus involve the formation of a compound object comprising a flat object to be wrapped and a covering element. A first main surface of the flat object is covered at least partially with a covering element for creating a projecting portion of the covering element. A plurality of compound objects are conveyed in series in a predetermined conveying-in trajectory. Then, a flow of compound objects are deflected about a wrapping roller having a longitudinal axis oriented transversely to the conveying-in trajectory. During deflection, each compound object is moved through a position where main surfaces of an associated flat object are oriented parallel to the radius of the wrapping roller, and in a moving trajectory substantially transverse to those main surfaces. During moving of each compound object, a first main surface of the associated flat object is oriented forward in the moving trajectory, a first edge of the flat object is oriented toward the wrapping roller, and a projecting portion of an associated wrapping element trails behind the flat object and is at least partially positioned on the wrapping roller. Each compound object is subsequently conveyed past the wrapping roller for forming a wrapped flat object, in a second conveying direction substantially parallel to the main surfaces of the flat object such that the first main surface of the associated flat object faces away from the wrapping roller.

20 Claims, 10 Drawing Sheets

FIG. 1
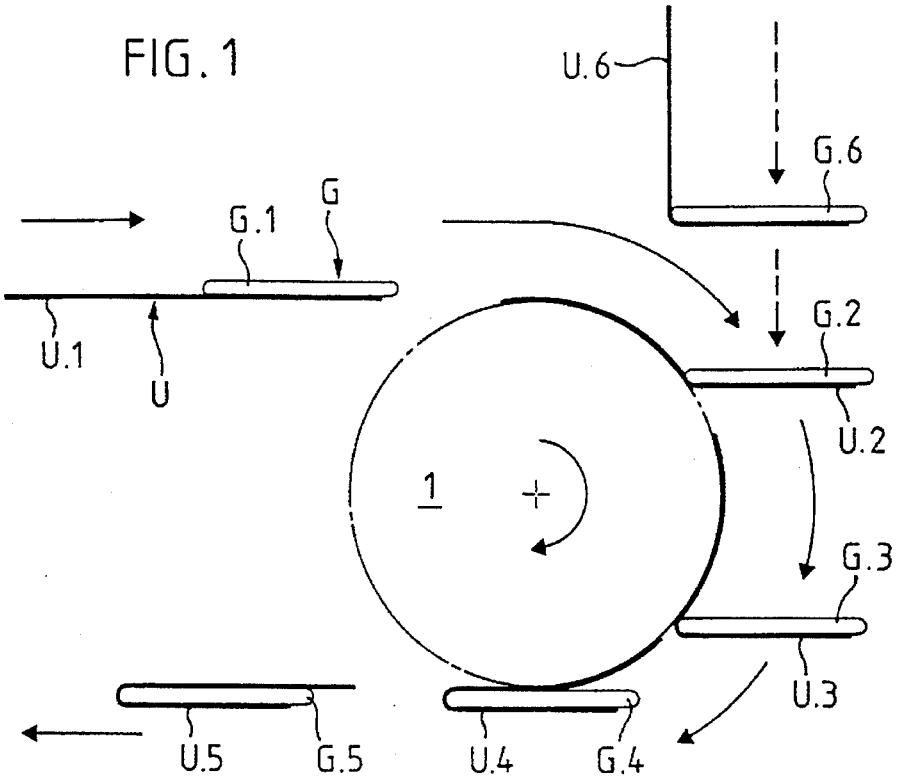
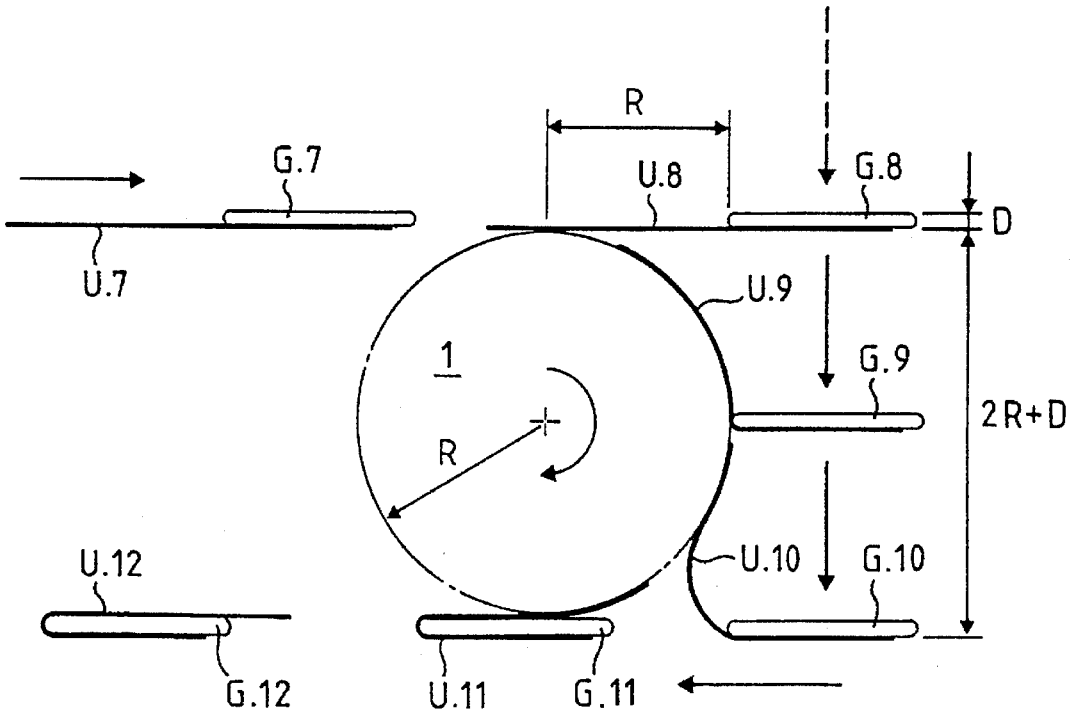
FIG. 2

METHOD AND APPARATUS FOR WRAPPING COVERING ELEMENTS AROUND PRINTED PRODUCTS

FIELD OF THE INVENTION

The invention relates to a method and an apparatus for wrapping covering elements around printed products or other flat objects according to the corresponding claims.

BACKGROUND OF THE INVENTION

Flat objects, particularly printed products are covered with plastic films or paper for their protection, e.g. for dispatch purposes. For this purpose individual or groups of printed products are for example rolled up or bent round twice to form a type of S-shaped roll and in the same working step are covered in such a way that the covering passes around the roll more than once and in the overlap area is joined to itself with the aid of glue or a material-inherent adhesiveness and can be closed in this way. The covering can be narrower than the roll and form a type of covering band. It can also be of the same width and cover the entire circumferential surface of the roll, or can be wider than the roll and in a further step is for example laterally folded in or welded, so that the roll is covered on all sides. Methods and apparatuses for such rolling or folding processes with a covering integrated into the process are for example described in EP . . . 568844, patent application EP-588758 and patent application CH-1000/93-0 corresponding to EP-618138 of the same applicant.

A method and an apparatus for the folding of printed products and simultaneously covering the flat-folded printed products is for example described in German patent 153 986. Here again the covering is substantially of the same width or narrower than the printed product and is so dimensioned in the covering direction that an overlap occurs and can be closed by the gluing of the overlap area.

All these prior art covering methods are necessarily associated with a shape change of the flat object (rolling, bending, folding) and cannot be used without this.

SUMMARY OF THE INVENTION

The object of the present invention is to provide a method and an apparatus for wrapping an enveloping or covering element round printed products or other flat objects, which are supplied individually or as groups to be jointly covered in a continuous manner. The method is to be usable independently of the inherent rigidity of the objects and without any shape change to the flat object, i.e. alone, but must also be easily combinable with the most varied folding or bending processes. The method must also be usable or easily adaptable for the most varied covering materials, particularly those of widely differing stiffnesses (thinnest plastic films, paper, thin board), and also in the case of stiffer covering materials a prefolding of the covering is not to be needed. The method is intended to make it possible to produce enveloping or covering bands, coverings with open ends and all-round coverings.

The apparatus for performing the method must be simple and inexpensive and should comprise components known in connection with the further processing of printed products.

This problem is solved by the method and the apparatus according to the invention.

The fundamental idea of the wrapping according to the invention is as follows. With the object is initially associated in per se known manner a covering element, the combination of the object and the covering element thereby forming a compound object. The covering element at least partly covers and projects over the edge of a main surface of the object thereby creating a projecting portion of the covering element. The object and the covering element associated therewith are then deflected about a wrapping roller or roll driven in rotary manner in the deflection direction. During the deflection the object passes through a position which is substantially radial with respect to the wrapping roll, in which its edge over which the covering element projects is directed against the wrapping roll, in which its main surface covered and projected over by the covering element is directed forwards in the conveying direction and in which the projecting part of the covering element in the conveying direction behind the object at least partly rests on the circumference of the wrapping roll. Following deflection the object is conveyed past the wrapping roll in a tangential position with respect to the latter and the other main surface facing the covered main surface is directed against the wrapping roll and the latter can roll over it. As a result of this deflection over a radial to a tangential position the covering element is firstly placed round the edge of the object which first projected over it and is then placed on the other main surface opposite to the originally covered main surface. As will be shown hereinafter, such a deflection can be achieved with very simple means on a serial flow of objects and associated covering elements. The above steps lead to a single wrapping of the flat object.

Variants are also conceivable in which the wrapping roll is passively rotatable or even stationary, particularly if the covering element has a relatively high stability. In place of a stationary wrapping roll it is also possible to have a wrapping device comprising a pair of oppositely angled wrapping surfaces, the object being conveyed past the first wrapping surface with main surfaces substantially at right angles thereto and past the second wrapping surface with main surfaces substantially parallel thereto.

As will be described hereinafter, numerous variants are possible in order to bring the object and the covering element associated therewith into the first position substantially radial relative to the wrapping roll and necessary for wrapping purposes.

If the covering element is dimensioned in such a way that after the first wrapping it still has a part which projects over the object, said further projecting part in a further wrapping stage can be again wrapped around the edge opposite to the first wrapped edge, so that it then comes to rest on the main surface initially covered by the covering element. The above steps therefore lead to a double wrapping of the flat object. With a double wrapping of the covering element about each edge of the flat object, the latter can be covered on both sides in such a way that it overlaps one main surface and the covering element can be closed in per se known manner in said overlap area.

BRIEF DESCRIPTION OF THE DRAWINGS

The method for wrapping a covering element around a flat object and an exemplified embodiment of an apparatus for performing the method according to the invention are described in greater detail hereinafter relative to the drawings, wherein:

FIGS. 1 to 3 show three exemplified variants of the wrapping method.

DETAILED DESCRIPTION OF THE PREFERRED EMBODIMENTS

Figure 3:
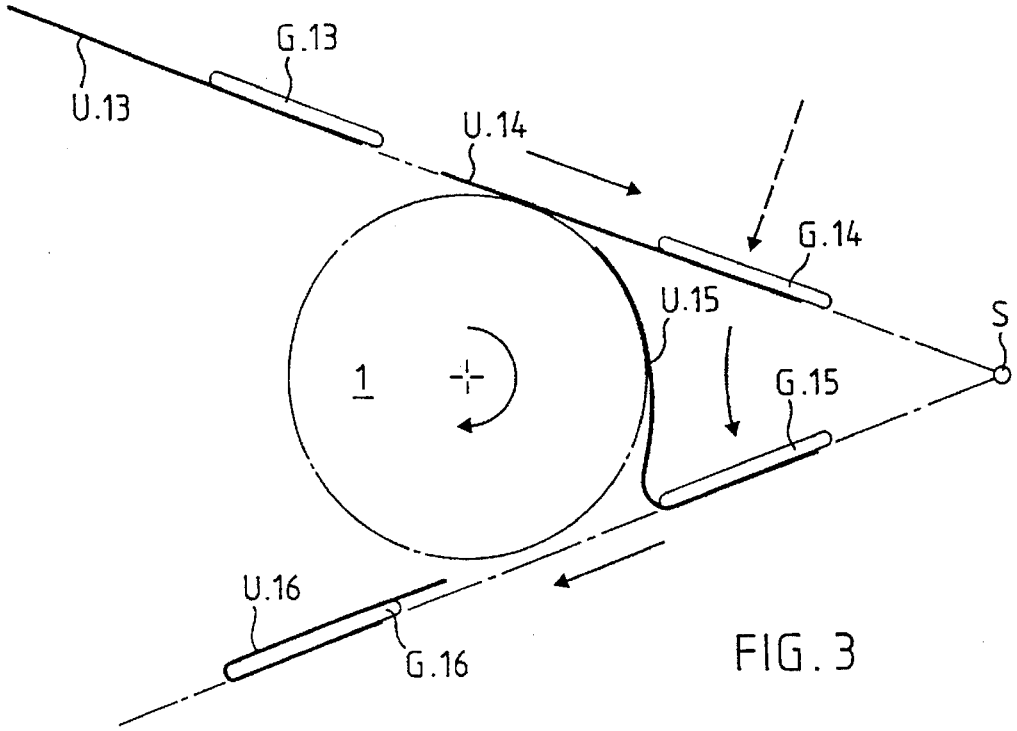

FIG. 1 very diagrammatically shows an exemplified variant of a setup used for wrapping, according to the invention, a covering or enveloping element U around a flat object G, the flat object and the covering element being associated therewith being shown in five randomly selected positions G.1/U.1 to G.5/U.5 during wrapping.

The object G and the covering element U are conveyed to the wrapping roll 1 jointly and a substantially tangentially (conveying in direction or trajectory and the main surface of the object being in a tangential plane to the wrapping roll) 1 and past the same, in such a way that a covering part at least partly covers a first main surface of the object facing the wrapping roll and the other covering part, that is the projection portion is behind the object (G.1/U.1). As soon the trailing edge of the object has passed the contact point with the wrapping roll, the object is deflected around the wrapping roll in such a way that it does not change its spatial orientation and its trailing edge during conveying in is guided around the circumference of the wrapping roll (G.2/U.2, G.3/U.3). The object passes through a position between G.2 and G.3 which is radial with respect to the wrapping roll, its first main surface covered with the covering element is directed forward in the conveying direction and the part of the covering element projecting over the object is guided in the conveying direction behind the object by the wrapping roll.

As soon as the object again comes to rest on the wrapping roll in a tangential plane (parallel to the tangential plane of the supply on the opposite side of the roll), it is moved past the wrapping roll and conveyed away (G.4/U.4, G.5/U.5), so that the wrapping roll rolls over the second main surface facing the main surface already covered by the covering element. The part of the covering element projecting over the object prior to deflection is now placed around the second leading edge of the object and onto the main surface facing the already covered first main surface. The object G and the part of the covering element U covering it are guided during the deflection around the wrapping roll in a manner not shown, which can differ as a function of the inherent rigidity of the object.

In the variant of the wrapping method according to a invention shown in FIG. 1 the trailing edge of the object to be wrapped during the supply is guided around the circumference of the wrapping roll and advantageously with essentially the same speed as that with which the circumferential surface of the wrapping roll moves and the objects are also conveyed in and out. Thus, as can be gathered from the drawing, at no time is there tension in the covering element, even if it is secured in its position relative to the object and adheres slightly to the wrapping roll. It is also ensured that the covering element part guided by the wrapping roll is at no time in front of the object edge guided round the wrapping roll, not even in a zonal manner, and that the part of the covering element projecting over the object is always completely guided. Thus, with this method variant it is ensured that also a not very stable and crease-prone covering element with a very limited inherent rigidity, such as a piece of adhesive film, can be placed without difficulty round the object.

If the covering element U is to be slightly tensioned round the object G, then the latter can be slightly accelerated with respect to the circumferential surface of the wrapping roll during the tangential conveying past and away (G.7/U.7), so that the covering part adhering slightly to the wrapping roll is slightly delayed compared with the object and is consequently tensioned. For performing the wrapping method there is no need to in any way prefold the covering element.

In a wrapping method according to the invention there is no necessary connection between the extension of the object or the projecting part of the covering element and the radius of the wrapping roll. Throughout the deflection around the wrapping roll the object can also be guided in spaced manner with respect thereto and it is then to be ensured that the spacing between the wrapping roll and the object is in no case greater than the extension of the projecting part of the covering element, in such a way that the latter is always guided by the wrapping roll.

If the individual positions of the object G and the covering element U (G.1/U.1 to G.5/U.5) were always represented equidistant from one another, they could also be looked upon as elements of a serial conveying flow of objects and associated covering elements about the wrapping roll 1. It can be easily gathered from the drawing that in such a conveying flow the minimum spacing between the objects corresponds to the extension in the conveying direction of the trailing covering part, if it is to be ensured that the covering elements are not to be superimposed on the wrapping roll.

The above-described variant of the wrapping method is marked in FIG. 1 with continuous arrows. FIG. 1 also shows a further variant (broken line arrows) for the supply of the object G and associated covering element U to the radial position of the object (G.6/U.6). The object and the associated covering element are not conveyed on a tangential plane and with trailing covering part to be wrapped against the covering roll and past the same and instead are conveyed with a conveying direction substantially corresponding to that for the radial position, the main surfaces of the object being oriented transversely to the conveying direction and the main surface covered by the covering element being directed forward in the conveying direction. It is advantageously ensured by corresponding means (e.g. rocker or airflow), that the projecting part of the covering element, as shown, trails behind the object.

FIG. 2 shows another exemplified variant of the wrapping, according to the invention, of a covering element U around a flat object G (positions G.7/U.7 to G.12/U.12). Unlike the method in FIG. 1, the object is not deflected in a curve corresponding to the wrapping roll 1 around the latter and is instead angled against the wrapping roll, and moves along substantially linear trajectories. The object which, as in the first variant, is conveyed in a tangential plane with a trailing covering part (G.7/U.7) is only deflected when it is already spaced from the wrapping roll (G.8/U.8). It is then conveyed substantially at right angles to the infeed direction through the radial position G.9 and then deflected again when it has once again reached a tangential plane G.10 past the wrapping roll in a direction parallel, but oppositely directed with respect to the infeed direction and conveyed away (G.11/U.11, G.12/U.12).

For the method variant shown in FIG. 2 it is appropriate to design the wrapping roll 1 in such a way that its radius R is in no case smaller than the length of the projecting covering part, so that the part of the covering element projecting over the object also at the time in which the object is in its position furthest from the circumference of the wrapping roll (G.8/U.8), it is still guided by the latter.

Unlike in the variant according to FIG. 1 it is more difficult for the variant according to FIG. 2 to make the speeds of the individual movements such that in the case of a covering element adhering slightly to the wrapping roll tensions in the covering element or unguided covering element parts are prevented. Thus, the method variant according to FIG. 2 is in certain circumstances less suitable than the variant according to FIG. 1 for wrapping materials with very little stiffness and which are very sensitive.

Particularly in the case of covering materials adhering easily to the wrapping roll and/or with very limited stiffness, it must be ensured by a corresponding choice of speeds of the individual movements that the covering part guided on the wrapping roll and which during deflection has to cover a smaller path than the object, on rolling over the main surface by the wrapping roll is not in front of the object before conveying away, because this could destroy the wrapping process. At a circumferential speed of the wrapping roll corresponding to the conveying in and away speed of the objects, in the case of negligible deceleration and acceleration times before and after deflections and in the case of object thicknesses D, which are negligible compared with the wrapping roll radius R, this means that for the movement part perpendicular to the conveying in and away direction an average speed is required which is at least twice that of the conveying in or away speed.

Also for the method variant according to FIG. 2 and as shown by the broken line arrow, it is possible to have a conveying in substantially perpendicular to the represented supply, i.e. in the conveying direction through the radial position, as has already been described relative to FIG. 1 and also shown with broken line arrows.

FIG. 3 shows another exemplified variant of the wrapping method according to the invention where, unlike in the variants of FIGS. 1 and 2 where the spatial position of the objects is substantially maintained, in this case there is a change thereto. The object G to be wrapped and the associated covering element U are once again conveyed on a tangential plane up to and past the wrapping roll 1 (G.13/U.13, G.14/U.14). If the object is at a sufficient distance from the wrapping roll, it is pivoted about a pivoting axis S parallel to the wrapping roll axis until it is once again located on a tangential plane. During the pivoting of the object and passes through a position radial with respect to the wrapping roll, the projecting part of the covering element is guided by the wrapping roll. On the second tangential plane the object is moved past the wrapping roll and conveyed away (G.15/G.15, G.16/U.16) in the manner described hereinbefore.

The position of the pivoting axis S is to be chosen in such a way that the object to be wrapped can be pivoted past the wrapping roll with the greatest extension in the conveying direction. The pivoting speed is to be so matched to the surface speed of the wrapping roll, that the projecting part of the covering element during the overrolling of the object by the rapid roll is not in front prior to the conveying away of the then leading edge of the object. This is particularly important for not very rigid covering elements which have a tendency to stick to the wrapping roll. For stiffer covering elements the precise matching of the speeds is not as important, because the wrapping roll can also move relative to such a covering element.

Also for the method variant according to FIG. 3 the wrapping roll radius and the position of the pivoting axis are advantageously such that the projecting part of the covering element is always guided by the wrapping roll throughout the deflection. It can also apply as a rough rule that the wrapping roll radius is not to be larger than the extension in the conveying direction of the projecting part of the covering element.

Also for the method variant according to FIG. 3 a second supply variant to the radial position is possible and as is once again indicated by a broken line arrow and as described in conjunction with the variant according to FIG. 1. Obviously mixed forms of the variants according to FIGS. 1, 2 and/or 3 are possible.

Figure 4:
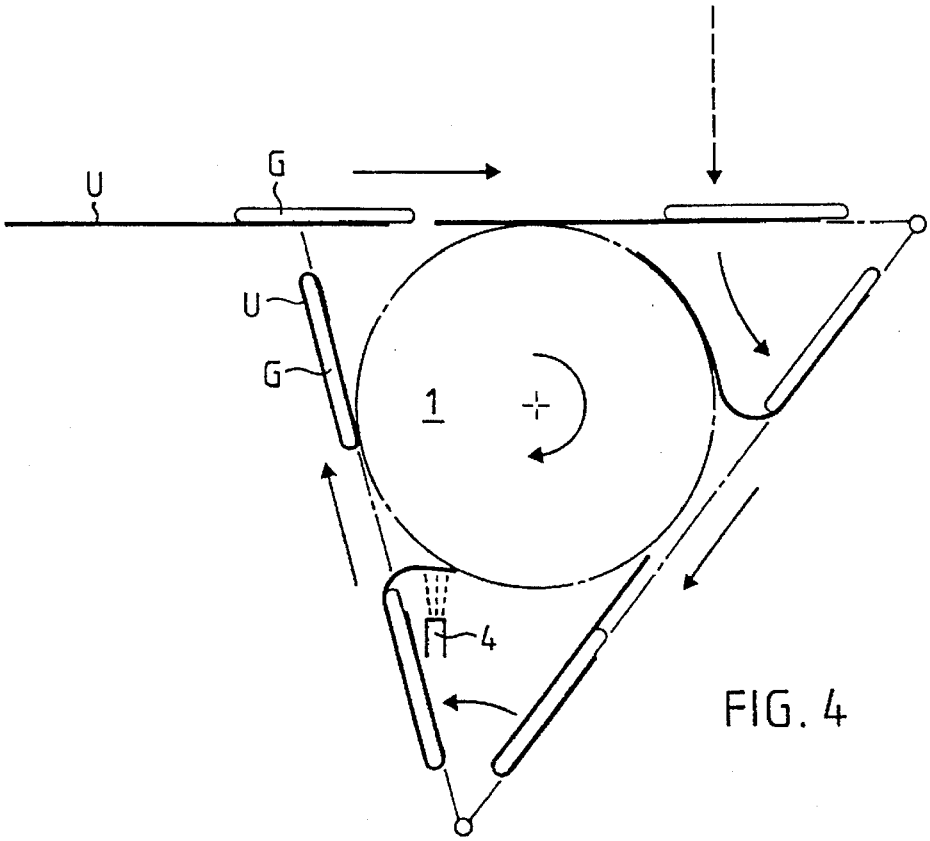
FIGS. 4 to 6 show three exemplified variants for methods for complete covering with at least one wrapping step.

FIG. 4 shows a very simple method variant for the two-sided wrapping of an object with a covering element. It is in this case a combination of two wrappings according to FIG. 3 around the same wrapping roll 1. In order that the guiding in and away can take place past one another, during the two deflections it is necessary to have a displacement of the objects parallel to the rotation axis of the wrapping roll. This can be prevented if the first supply, as indicated by the broken line arrow, is performed substantially perpendicular to the main surfaces of the objects. Obviously a complete covering, as represented in FIG. 4, can also be brought about with two wrapping rolls. As is apparent from FIG. 4, in the two-sided wrapping of an object, the second main surface of the object in the second wrapping stage assumes the same relative orientations with respect to the wrapping roll as the first main surface of the object during the first wrapping stage.

In the vicinity of the second wrapping, as is very diagrammatically indicated with a spraying nozzle 4, an adhesive can be applied to the covering part projecting over the object in such a way that the object, as conveyed from the second wrapping, is not only covered on both sides, but also the covering is already closed in its overlap area.

Instead of applying adhesive e.g. by spraying to the covering element shortly prior to wrapping for closing the covering element it is also possible to use other adhesion methods. For example, even before the association with the object on the covering element a hot melt adhesive can be applied, which is not sticky in the cold state. It can be activated in the vicinity of the wrapping or pressing by the supply of heat.

Figure 5:
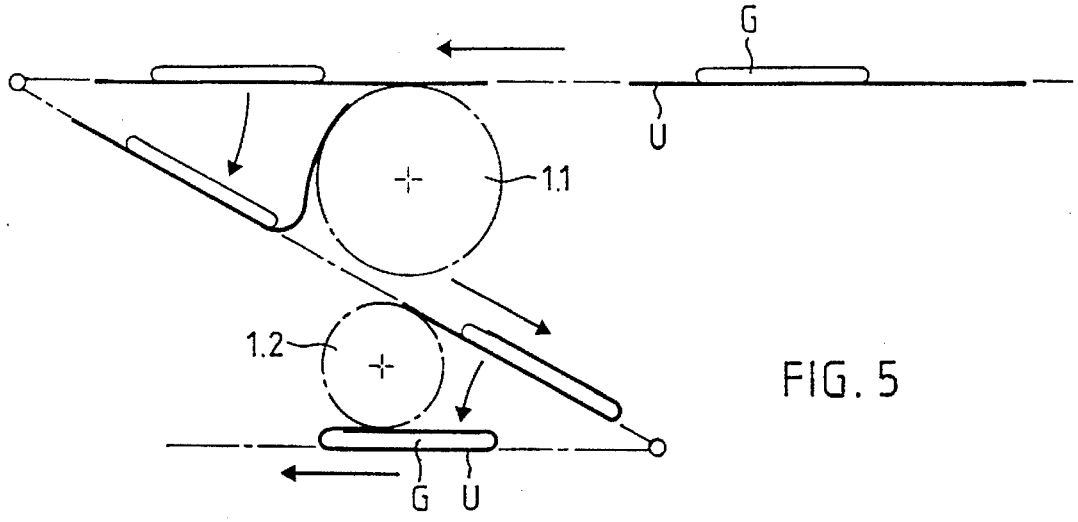

FIG. 5 shows a method variant for the two-sided covering of flat objects with a covering element, in which the wrapping method according to the invention is used twice. The covering element is associated with the object in such a way that it projects over both sides thereof. In a first wrapping according to the variant of FIG. 3, the larger projecting part being wrapped on a larger wrapping roll 1.1 and then the smaller projecting part with a smaller wrapping roll 1.2.

Figure 6:
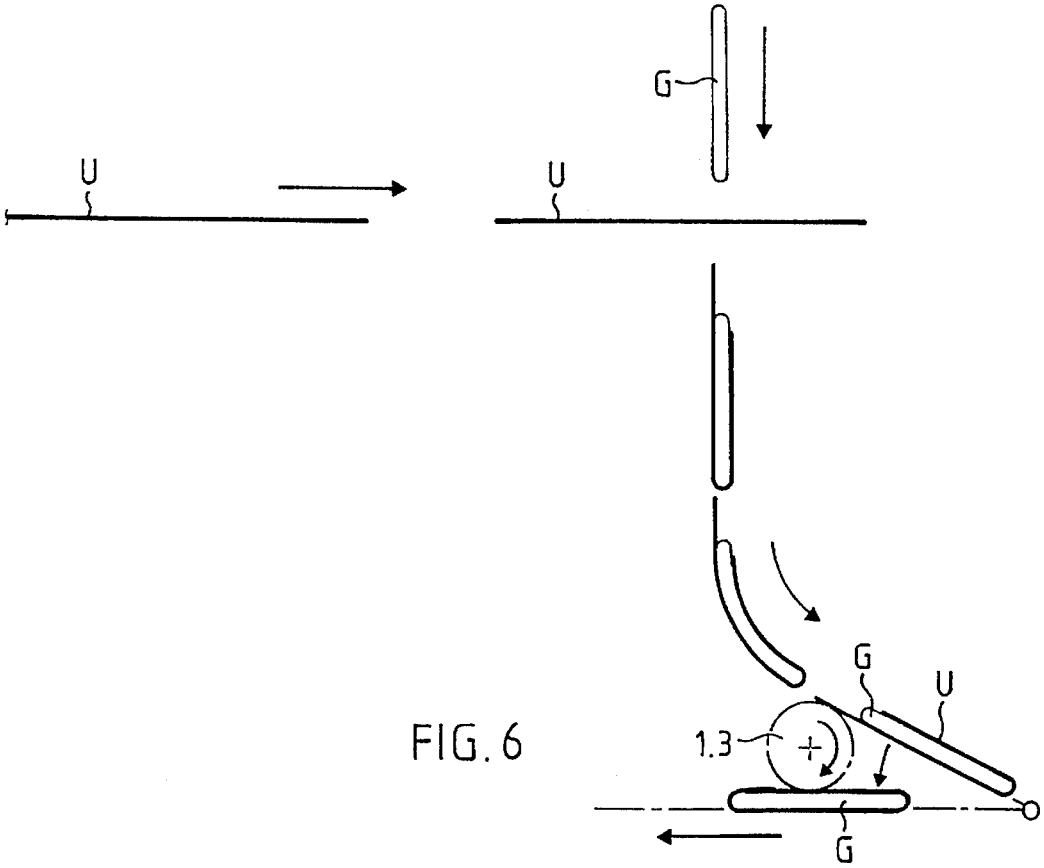

FIG. 6 shows another variant for the two-sided covering of a flat object G with a covering element U. The covering element and the object are supplied substantially perpendicular to one another to a reciprocal association in such a way that the covering element at the association is placed around the edge of the object and its two main faces are at least partly covered and projects over one of them. Such an association is only possible if the object to be covered has a sufficient inherent rigidity or if it is for example guided between two bands or is supported by a folding blade. Then by deflection around a wrapping roll 1.3 wrapping takes place around the projecting covering part, so that the object is covered on both sides. In the curved guide between the association and the wrapping the covering element and the object can be additionally conveyed in a pressed manner between two conveyor belts.

Figure 7:
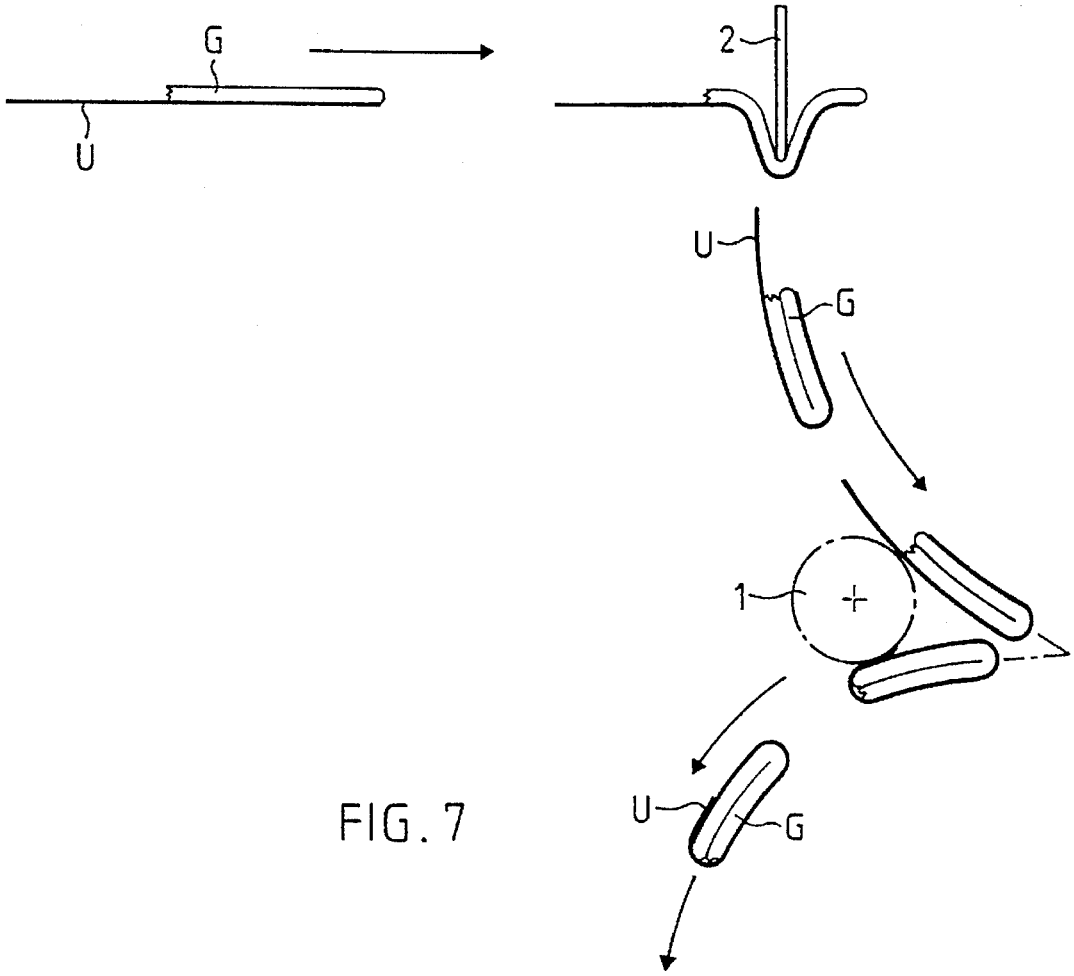
FIGS. 7 and 8 show two exemplified variants for methods for complete covering with at least one wrapping step, combined with folding or bending processes.

FIG. 7 shows the wrapping method according to the invention by deflection around a wrapping roll 1 (variant according to FIG. 3) combined with an upstream bending or folding process, in which with the aid of a folding blade 2 the flat object G (e.g. an already folded newspaper) and the covering element U associated therewith are simultaneously bent or folded. The method product is a curved or folded, two-sided covered object. The curved guided conveying paths between the folding and wrapping and following wrapping are once again used for pressing, which for the case that the object is not folded, but instead only curved, can be omitted.

Figure 8:
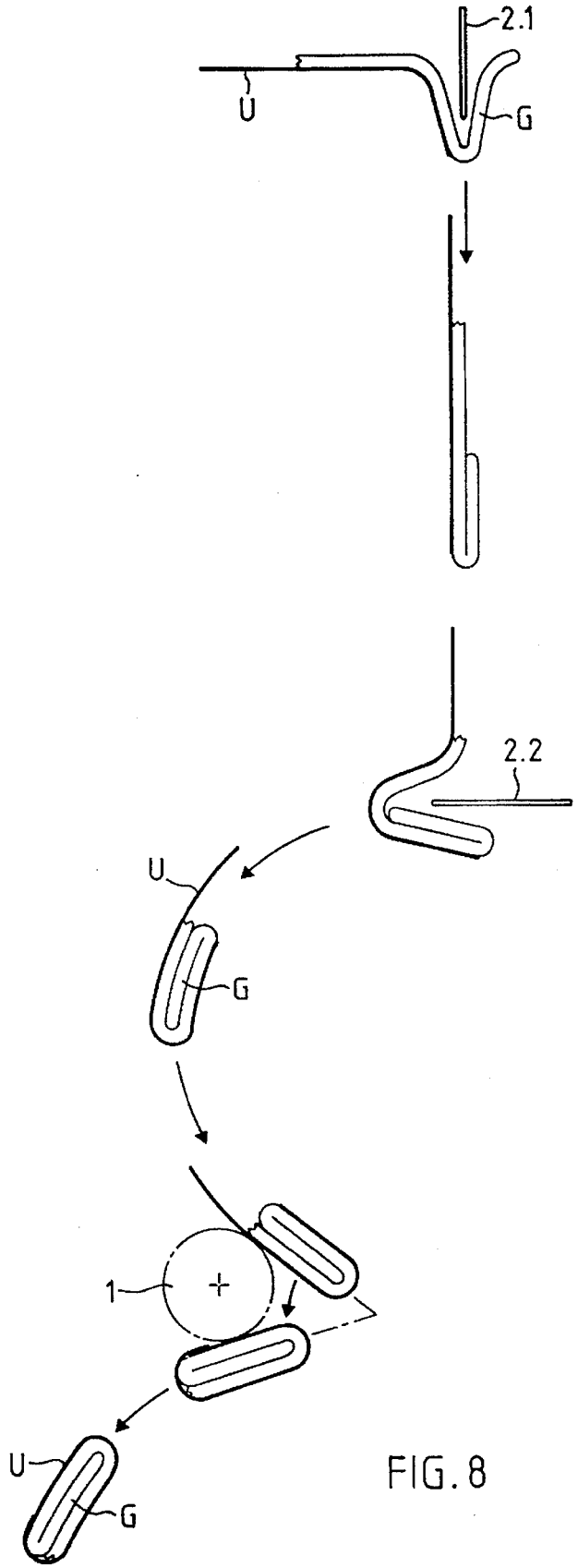

FIG. 8 shows another combination of folding or bending of the object together with the associated covering element with the aid of two folding blades 2.1 and 2.2 and a wrapping according to the invention by deflection around a wrapping roll 1. As a function of the interposed pressing steps, the product is a two-sided covered object twice bent into one another in the manner of a flat roll or twice folded in the same direction.

Figure 9A:
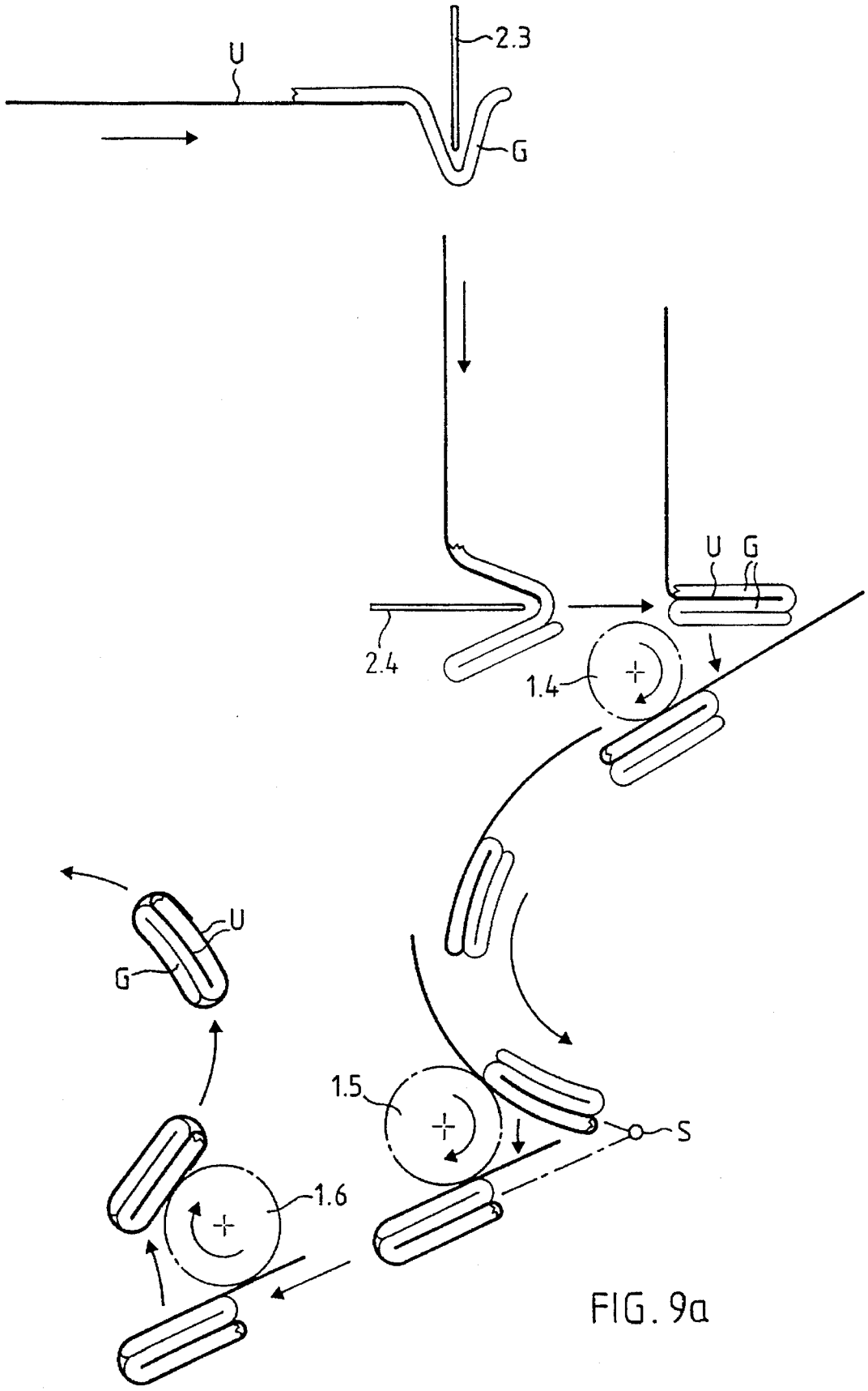
FIGS. 9*a* and 9*b* show two further variants for methods for complete covering with at least one wrapping step, combined with at least one folding or bending step for producing S-shaped bent or folded and covered objects.

FIG. 9*a* shows a combination of two bending or folding steps in which with the aid of two folding blades 2.3 and 2.4 the object and in the second step also the covering element are bent or folded in opposite directions to a S-shaped structure. Part of the covering element is folded between the two legs of the S-shaped structure. Then the part of the covering element still projecting over the folded object is wrapped by wrapping three times round the wrapping rolls 1.4, 1.5 and 1.6 and consequently the twice folded object is covered.

Figure 9B:
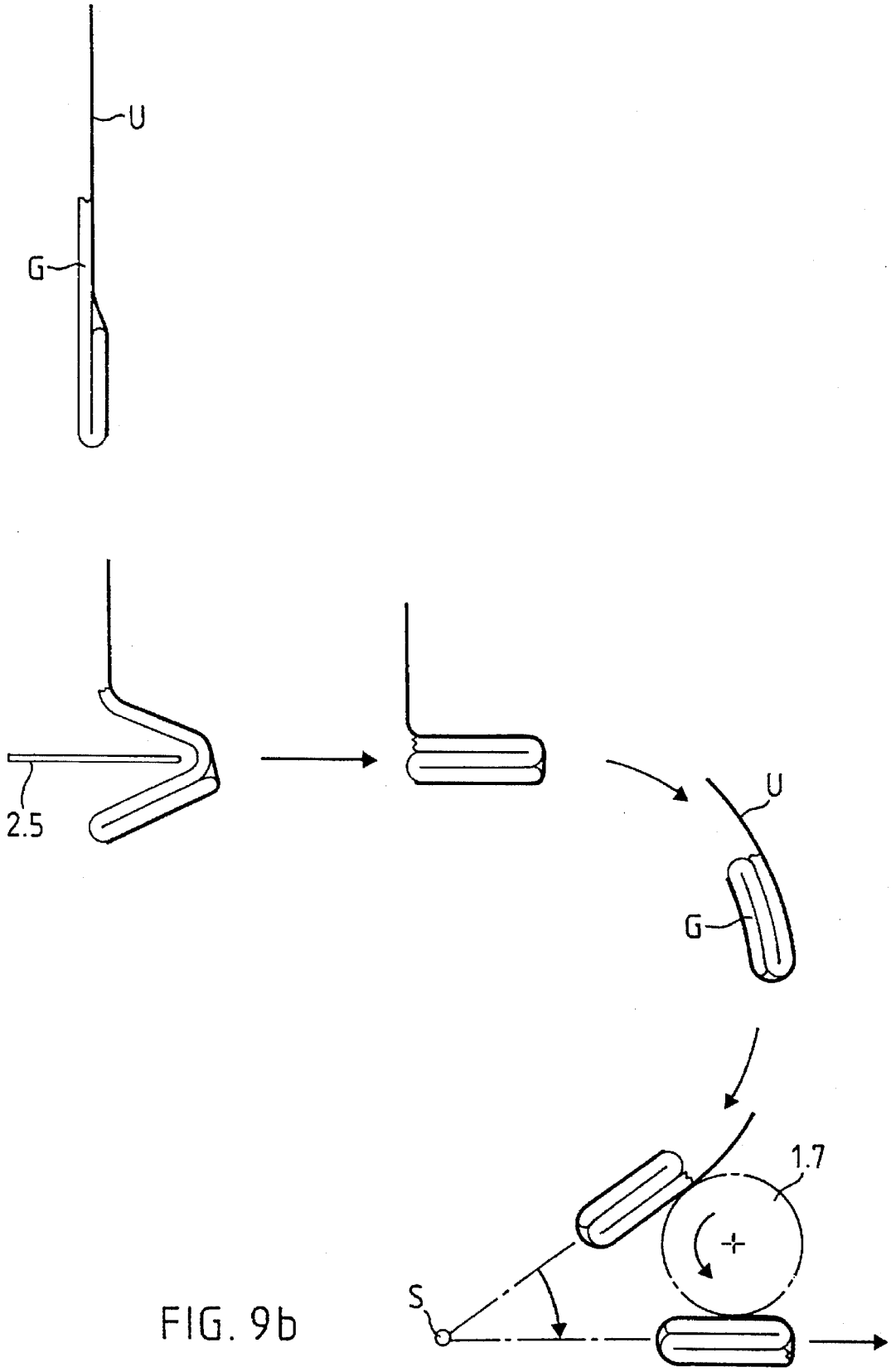

FIG. 9*b* shows a combination of a bending or folding step with a deflection according to the invention for producing a S-shaped curved or folded and covered object (like FIG. 9*a*). The covering element is only associated with the object when the latter has already been bent or folded once and mainly in such a way that the covering element covers the surface with the folded round part, the folded edge is leading and the covering element projects over the unfolded edge. Then, using a folding blade 2.5 the second fold is produced from the side opposite to the covering element. With the second folded edge as the leading edge the object and the covering element, optionally following a pressing is deflected around the wrapping roll 1.7 in such a way that after deflection the first folded edge is the leading edge and the covering element is also placed round the same.

Figure 10A:
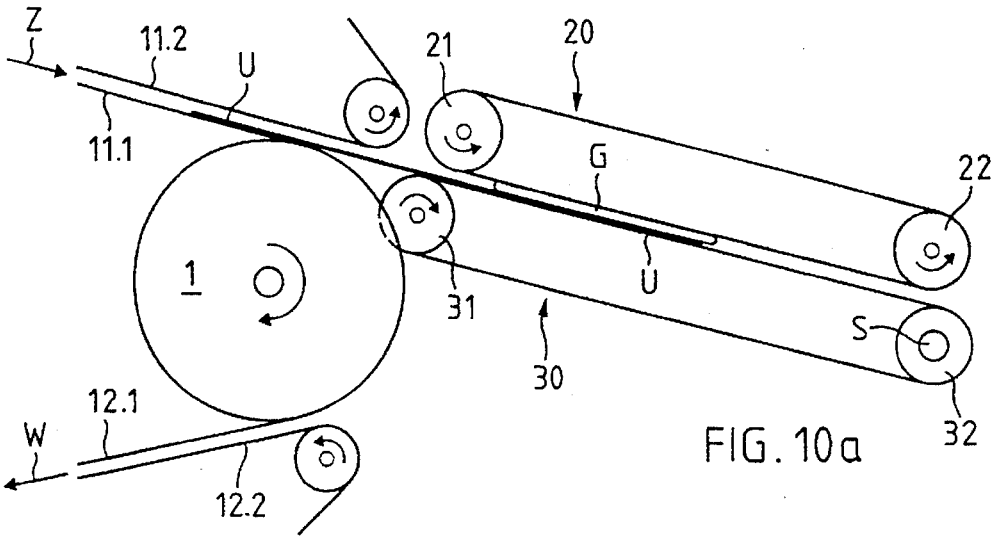
FIGS. 10*a* to 10*c* show an exemplified embodiment of an apparatus for performing the wrapping method according to the invention in three different positions during a wrapping operation.
Figure 10B:
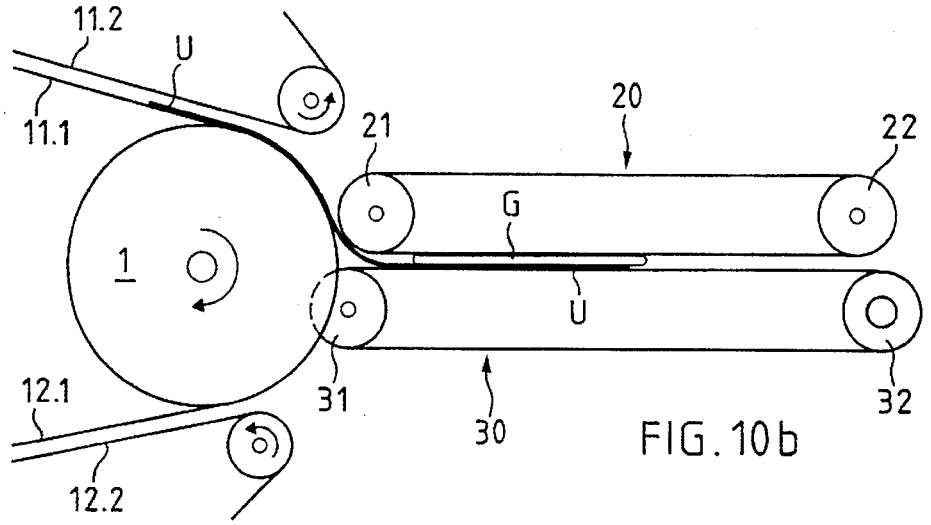
Figure 10C:
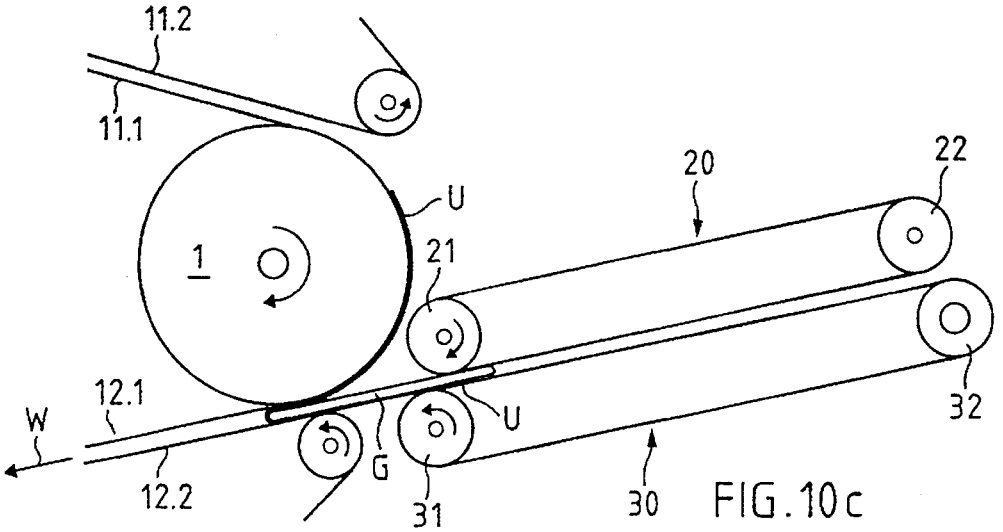

FIGS. 10*a* to 10*c* show an exemplified apparatus for performing the rapid method according to the invention. The apparatus is shown with a viewing angle parallel to the rotation axis of the wrapping roll 1, i.e. transversely to the plane in which the movement or the flow of the objects takes place. The means for the conveying of the objects G and the covering elements U are in this embodiment exclusively pairs of conveyor belts between which are conveyed the objects and the associated covering elements. These pairs of conveyor belts are shown spaced from one another in the drawings. So that the object and the covering element, which in most cases have a different thickness, can be conveyed equally well and reliably, the belts are advantageously pretensioned and the guide rolls are resiliently mounted, so that the belts adapt to the thickness of an object or covering element located between them and exert a slight pressure thereon.

The wrapping roll 1 at the same time constitutes a guide roll of a conveyor belt, which on the conveying in side is part 11.1 of the conveying in pair of conveyor belts (11.1/11.2) and on the conveying away side part 12.1 of the conveying away pair of conveyor belts (12.1/12.2). The conveying gap formed by the conveying in or away pair of conveyor belts forms a conveying in passage and a conveying away passage respectively defining a conveying in or out direction Z and W. On the side of the wrapping roll opposite to the conveying in and conveying away side is provided a pair of pivotable conveyor belts 20 and 30 with in each case two guide rolls 21, 22 and, 31, 32 substantially parallel to one another, which are driven in opposite directions and whose revolving direction is reversible. In addition, the belts of the pivoting belt pair are pivotable to a limited extent around one (32, S) of the guide rolls thereof remote from the wrapping roll 1, so that they are pivotable from a position in which the conveying gap formed between them essentially forms a linear extension to the conveying in direction Z into a position in which the conveying gap essentially forms a linear extension to the conveying away direction W.

FIG. 10*a* shows the apparatus in the position assumed if an object is conveyed in and past the wrapping roll 1 (first tangential position). The pivoting belts are positioned in the location of the conveying in direction Z and the rotation direction thereof is such that the facing belt parts move away from the wrapping roll.

FIG. 10*b* shows the pivoting belts 20 and 30 in a radial position relative to the wrapping roll 1. The distance between the pivoting belts and the wrapping roll is the smallest in this position.

FIG. 10*c* shows the apparatus in the second tangential position in which the pivoting belts are located in the conveying away direction W. In this position the spacing between the wrapping roll and the pivoting belt pair is at its greatest.

In order to keep as small as possible the gap between the individual conveyor systems (conveying in pair, pivotable pair, conveying away pair of belts), the belt 11.1/12.1 around the wrapping roll 1 and the wrapping roll 1 itself in the axial direction can be subdivided into two or more spaced partial belts or rolls, as well as also at least the pivoting belt 30 leading during pivoting, the pivoting belt parts being oriented to the spacings between the wrapping roll parts. This is diagrammatically shown in the drawing by a partial overlap of the wrapping roll 1 and the guide roll 31 of the pivoting belt 30. In such an apparatus in the tangential positions of the pivoting belt pair the spacings between the conveying in or away means and the pivoting belt pair are smaller, so that locations without guidance for the objects and in particular for the projecting covering parts are as small as possible.

If the covering (in the wrapping roll axis direction) is smaller than the object to be covered, also the trailing pivoting belt 20 during pivoting can be subdivided into spaced partial belts and for example centrally a part must be provided, whose width is at least the same as the width of the covering element.

The simplest operation of the apparatus according to FIGS. 10*a* to 10*c* from the control standpoint comprises conveying the object with the conveying in speed between the two pivoting belts to such an extent that the spacing between the trailing edge of the object and the wrapping roll is such that the object can be pivoted past the latter, followed by the stopping of the pivoting belts, the performance of the necessary pivoting, the restarting of the pivoting belts in the opposite direction at the conveying away speed and the moving of the object away past the wrapping roll. This operation precisely corresponds to the method described relative to FIG. 3. As mentioned in that connection, it is relatively difficult to set up the operation in such a way that tensions are avoided in the covering element if it adheres slightly to the wrapping roll. Therefore it is advantageous to adopt an operating procedure in which the pivoting movement is initiated as soon as the object has left the vicinity of the conveying in belts and in which, before the object has reached its position closest to the pivoting axis said pair of pivoting belts are stopped and started up again in the opposite direction when the object passes through the radial position. As a function of the relationship of the speeds, such an operation constitutes a mixed method between those of FIGS. 1 and 3.

As the pivoting belts must be moved back from the second into the first tangential position before they can handle a next object from a serial flow of objects with associated covering elements, the minimum spacing between the supplied objects is not, as explained in conjunction with the method, purely dependent on the extension of the covering part projecting over the object, but additionally on the time required by the pivoting belt pair for pivoting back.

Figure 11:
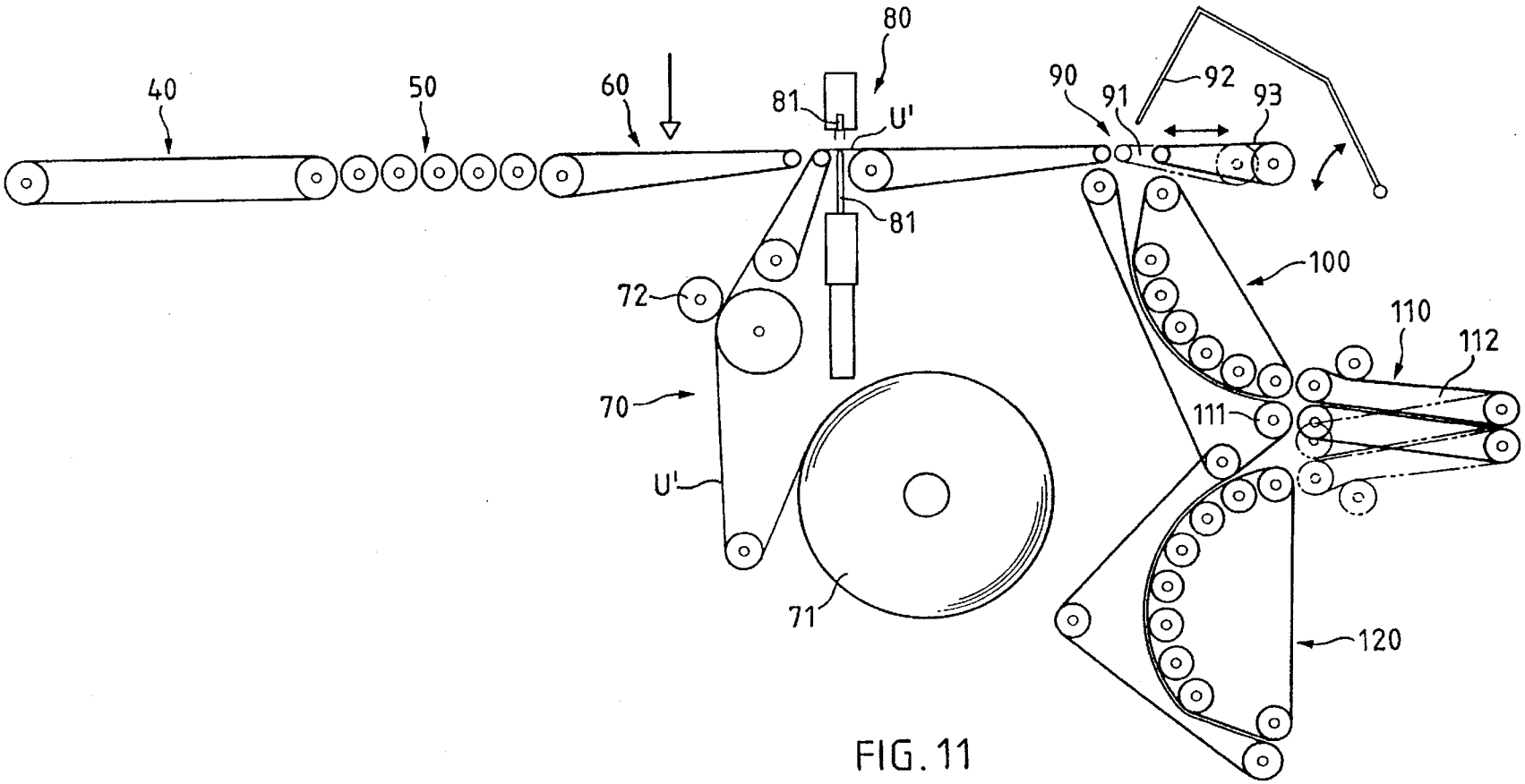
FIG. 11 shows a complete arrangement for the association of covering elements with objects and the covering thereof combined with a bending or folding.

FIG. 11 shows an exemplified apparatus for performing the method according to FIG. 7, i.e. for an association of in each case one covering element with each object of a serial flow, a single folding of the object and covering element and a complete covering of each object by deflection about a wrapping roll.

The arrangement has a supply device 40, e.g. in the form of a supply belt for the supply of the objects. This is followed downstream in the conveying direction by a straightening station 50, in which the objects are laterally oriented e.g. by a series of inclined rollers. This is disposed upstream of a control station 60 (diagrammatically indicated by an arrow), in which e.g. by a thickness measurement the objects are subject to a control. Following the control there is the covering supply device 70 of the covering material U', which material is supplied from a storage reel 71 with an engageable and disengageable coupling roller 72 in controlled manner in the conveying path. This is followed by a cutting station 80 for cutting the covering material U' into individual covering elements, in which for example a pair of controlled movable blades 81 are moved transversely to the conveying path and separate or cut up the material U'. This is followed by a folding device 90 with a folding gap 91 and a folding blade 92 movable into the gap. Advantageously the folding gap 91 is closable by a conveyor belt 93 movable in the conveying direction, so that objects which have been detected as faulty by the control station and with which no covering element has been associated by a corresponding control are conveyed on linearly over the folding gap 91 and can be discharged or returned. The folding device 90 is followed by a pressing device 100 in the form of a pair of curved guided conveying belts between which the folded objects are exposed to a pressure perpendicular to their main surfaces. This is followed by a wrapping device 110 according to FIGS. 10*a* to 10*c* with a wrapping roll 111 and a pivoting belt pair 112. This is followed by a pressing path 120 between two curved guided conveyor belts. The objects supplied at the end of this pressing path are completely covered and can then e.g. be supplied to an addressing station.

Per se the individual components of an arrangement according to FIG. 11 are known and consequently need not be described in detail here.

Figure 12:
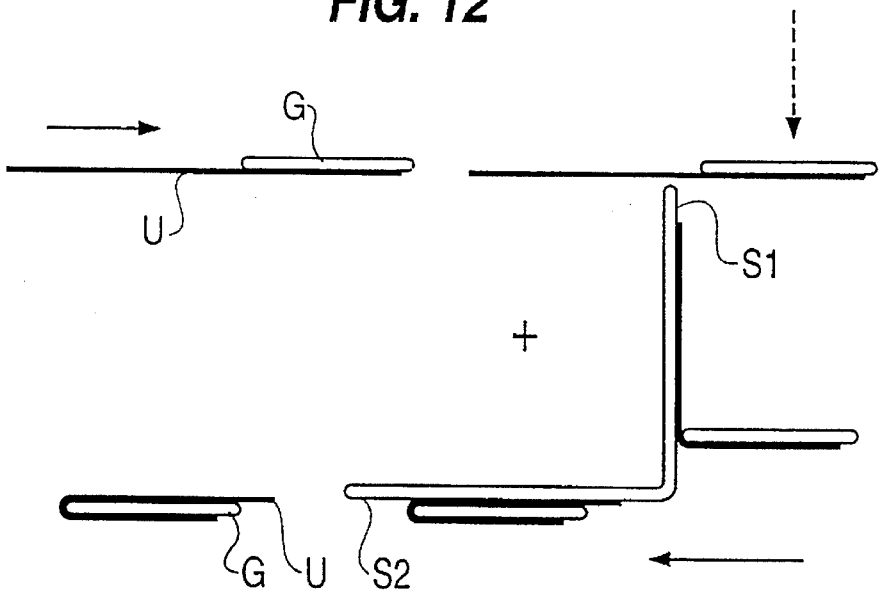
FIGS. 12 and 13 show alternative variants of the methods of FIGS. 2 and 3, respectively.
Figure 13:
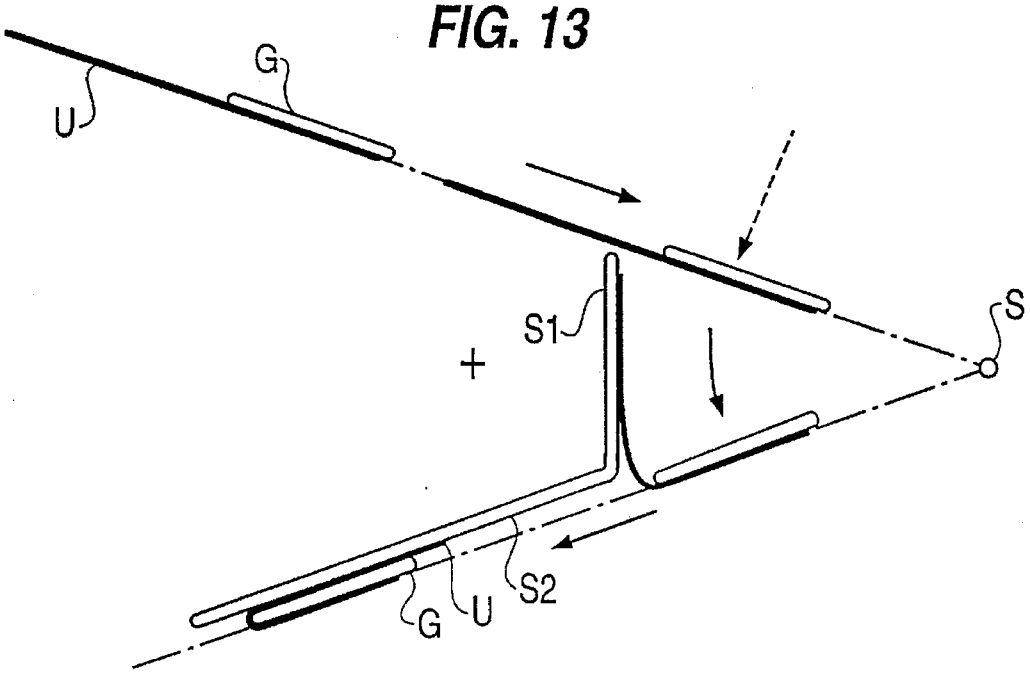

FIGS. 12 and 13 show variants of the methods of FIGS. 2 and 3, respectively, which variants include an angled wrapping device having a first wrapping surface S1 and a second wrapping surface S2 for covering the flat objects.

If the covering element transversely to the conveying direction is wider than the object with which it is associated, it is advantageously associated therewith that it projects uniformly over both sides of the object thereby forming lateral extensions of the covering element. The lateral extensions are not impaired by an overall arrangement, such as is for example shown in FIG. 11, and after passing through the arrangement can be closed by folding in and bonding or by welding, so that the finished product is covered on all sides.

We claim:

1. A method for wrapping covering elements around flat objects, each of the flat objects having a first main surface, a second main surface substantially parallel to the first main surface, a first edge, and a second edge disposed opposite the first edge, the method comprising the steps of:

forming a compound object comprising a flat object to be wrapped and a covering element by covering at least partially the first main surface of the flat object with the covering element such that the covering element projects beyond the first main surface of the flat object over the first edge thereof thereby creating a projecting portion of the covering element;

conveying in series a plurality of compound objects in a predetermined conveying-in trajectory at a predetermined conveying-in speed, the compound objects being spaced from one another; and deflecting a flow of compound objects about a wrapping roller having a longitudinal axis oriented perpendicularly to the conveying-in trajectory, the step of deflecting including the steps of:

moving each of the compound objects through a position where the main surfaces of an associated flat object are oriented parallel to a radius of the wrapping roller, and in a moving trajectory substantially perpendicular to the main surfaces of the associated flat object, whereby, during the step of moving, the first main surface of the flat object is oriented forward in the moving trajectory, the first edge of the flat object is oriented toward the wrapping roller, and the projecting portion of an associated wrapping element trails behind the associated flat object and is at least partially positioned on the wrapping roller;

subsequently conveying each of the compound objects in a second conveying direction substantially parallel to the main surfaces of the associated flat object such that the first main surface of the associated flat object faces away from the wrapping roller and such that the projecting portion of the associated wrapping element is at least partially positioned on the wrapping roller, the step of subsequently conveying including the step of conveying each of the compound objects past the wrapping roller thereby forming a wrapped flat object; and rotating the wrapping roller about its longitudinal axis in a flow direction of the compound objects at a rotational speed corresponding to the conveying-in speed.

2. The method according to claim 1, wherein the step of subsequently conveying includes the step of rolling the wrapping roller over the second main surface of the associated flat object when the compound object is being conveyed past the wrapping roller thereby covering the second main surface of the associated flat object with the projecting portion of the associated covering element.

3. The method according to claim 1, wherein the step of conveying in series includes the step of conveying the compound objects in a direction substantially tangential with respect to the wrapping roller and parallel to the main surfaces of the associated flat objects, the projecting portion of each covering element trailing behind an associated flat object.

4. The method according to claim 1, wherein the conveying-in trajectory is substantially perpendicular to the main surfaces of the flat objects.

5. The method according to claim 1, wherein the steps of conveying in series and deflecting include the step of maintaining a spatial orientation of each of the flat objects.

6. The method according to claim 1, wherein the step of moving includes the step of pivoting each of the compound objects about a pivot axis parallel to the longitudinal axis of the wrapping roller and spaced therefrom.

7. The method according to claim 1, wherein the step of forming a compound object includes the step of creating a projecting portion of the associated covering element which is longer than the second main surface of the associated flat object, the method further comprising the step of completely covering each of the flat objects with a single covering element by a double wrapping of the flat object with at least one wrapping roller.

8. The method according to claim 1, wherein the step of forming a compound object includes the step covering at least partially the first main surface of the flat object with the covering element such that the covering element projects beyond the first main surface of the flat object over both the first edge and the second edge thereof thereby creating two projecting portions of the covering element, the method further comprising the step of completely covering each of the flat objects with a single covering element by a double wrapping of the flat object with two wrapping rollers.

9. The method according to claim 1, further comprising the step of completely covering each of the flat objects with a single covering element by a single wrapping of the flat object with single wrapping roller.

10. The method according claim 1, wherein the step of forming a compound object includes the steps of:

covering at least partially the first main surface of the flat object with the covering element such that the covering element does not project beyond the first main surface of the flat object over the second edge thereof; and folding the flat object and the associated covering element at least once prior to the step of conveying in series.

11. The method according to claim 1, and further including the step of pressing each of the compound objects both before and after the step of deflecting.

12. The method according to claim 1, and further including the step of applying adhesive to portions of each of the covering elements which are long enough to overlap each other after each wrapping.

13. The method according to claim 1, wherein the step of forming a compound object includes the step of covering at least partially the first main surface of the flat object with the covering element such that the covering element does not project beyond the first main surface of the flat object on either side thereof in a direction parallel to the longitudinal axis of the wrapping roller.

14. The method according to claim 1, wherein the step of forming a compound object includes the step of covering at least partially the first main surface of the flat object with the covering element such that the covering element projects beyond the first main surface of the flat object on either side thereof in a direction parallel to the longitudinal axis of the wrapping roller thereby forming lateral extensions of the covering element; the method further comprising the step of closing the lateral extensions by at least one of folding, bonding and welding.

15. An apparatus for wrapping covering elements around flat objects, each of the flat objects having a first main surface, a second main surface substantially parallel to the first main surface, a first edge, and a second edge disposed opposite the first edge, the apparatus comprising:

means for forming a compound object from a flat object to be wrapped and a covering element by covering at least partially the first main surface of the flat object with the covering element such that the covering element projects beyond the first main surface of the flat object over the first edge thereof thereby creating a projecting portion of the covering element;

means for conveying in series a plurality of compound objects in a conveying-in trajectory at a predetermined conveying-in speed, the compound objects being spaced from one another, the means for conveying being in communication with the means for forming for receiving compound objects therefrom;

a wrapping roller having a longitudinal axis oriented perpendicular to the conveying-in trajectory, the wrapping roller having a surface being in flow communication with the means for conveying;

means for deflecting a flow of compound objects about the wrapping roller, the means for deflecting being in flow communication with the means for conveying and the surface of the wrapping roller and including:

means for moving each of the compound objects through a position where the main surfaces of an associated flat object are oriented parallel to a radius of the wrapping roller and in a moving trajectory substantially perpendicular to the main surfaces of the associated flat object, whereby the first main surface of the flat object is oriented forward in the moving trajectory, the first edge of the flat object is oriented toward the wrapping roller, and the projecting portion of an associated wrapping element trails behind the associated flat object and is at least partially positioned on the wrapping roller;

means for subsequently conveying each of the compound objects in a second conveying direction substantially parallel to the main surfaces of the associated flat object such that the first main surface of the associated flat object faces away from the wrapping roller and such that the projecting portion of the associated wrapping element is at least partially positioned on the wrapping roller, the means for subsequently conveying being in flow communication with the means for moving and being effective for conveying each of the compound objects past the wrapping roller for forming a wrapped flat object; and means for rotating the wrapping roller about its longitudinal axis in a flow direction of the compound objects at a rotational speed corresponding to the conveying-in speed.

16. The apparatus according to claim 15, wherein:

the means for conveying and the means for subsequently conveying include a first conveyor belt deflected about the wrapping roller;

the means for conveying further includes a second conveyor belt cooperating with the first conveyor belt on a conveying in side of the wrapping roller to form a conveying in passage for the compound objects, the conveying in passage defining the conveying-in trajectory;

the means for subsequently conveying includes a third conveyor belt cooperating with the first conveyor belt on a conveying away side of the wrapping roller to form a conveying away passage for the compound objects; and the means for moving includes a fourth conveyor belt and a fifth conveyor belt cooperating to form a deflecting passage for the compound objects, the deflecting passage being pivotal about a pivot axis disposed parallel to the longitudinal axis of the wrapping roller and spaced therefrom, the deflecting passage being pivotal into registration with the conveying in passage to receive a compound object therefrom in a conveying in direction, the deflecting passage thereafter being pivotal through a position where the main surfaces of an associated flat object are oriented parallel to the radius of the wrapping roller, the deflecting passage being subsequently pivotal into registration with the conveying in passage to convey the compound object thereto in a conveying away direction.

17. The apparatus according to claim 16, wherein the second conveyor belt is guided about a first guide roller, the third conveyor belt is guided about a second guide roller, the fourth conveyor belt is guided about a third guide roller and a fourth guide roller, and the fifth conveyor belt is guided about a fifth guide roller and a sixth guide roller, the second conveyor belt, the third conveyor belt, the fourth conveyor belt, and the fifth conveyor belt being pretensioned, at least one of the guide rollers being resiliently mounted.

18. The apparatus according to claim 17, wherein at least one of the third guide roller, the fourth guide roller, the fifth guide roller, and the sixth guide roller rests against the wrapping roller, and wherein the wrapping roller, the first conveyor belt, at least one of the fourth conveyor belt and the fifth conveyor belt, and the at least one roller resting against the wrapping roller comprise partial element in a direction parallel to the longitudinal axis of the wrapping roller, the wrapping roller, the fourth conveyor belt, and the fifth conveyor belt being positioned such that the partial elements engage one another during pivoting of the deflecting passage.

19. The apparatus according to claim 15, further including a folding blade for folding the compound objects, the folding blade being positioned upstream of the conveying-in trajectory.

20. The apparatus according to claim 15, wherein the means for forming includes:

a covering supply device for supplying covering material to each flat object; and a cutting station disposed downstream of the covering supply device for cutting the covering material thereby forming a covering element associated with each flat object;

the apparatus further including:

a straightening station disposed upstream of the means for forming for laterally orienting the flat objects;

a control station disposed downstream of the straightening station for controlling a flow of the flat objects as a function of predetermined physical parameters thereof; and at least one pressing device disposed one of upstream and downstream of the means for deflecting for pressing each compound object.

* * * * *